US007857489B2

(12) United States Patent
Zhu et al.

(10) Patent No.: US 7,857,489 B2
(45) Date of Patent: Dec. 28, 2010

(54) MIXED LIGHT APPARATUS

(75) Inventors: Jun Zhu, Beijing (CN); He Zhang, Beijing (CN); Guo-Fan Jin, Beijing (CN)

(73) Assignees: Tsinghua University, Beijing (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 193 days.

(21) Appl. No.: 12/180,209

(22) Filed: Jul. 25, 2008

(65) Prior Publication Data

US 2009/0040757 A1 Feb. 12, 2009

(30) Foreign Application Priority Data

Aug. 10, 2007 (CN) ..... 2007 1 0075669

(51) Int. Cl.
*F21V 5/00* (2006.01)

(52) U.S. Cl. ..... 362/311.08; 362/237; 362/346; 362/616

(58) Field of Classification Search ..... 362/615, 362/616, 551, 556, 561, 235–238, 240, 241, 362/581, 346, 311.01, 311.02, 311.06, 311.08, 362/311.1, 335, 336, 338, 340; 359/708–712, 359/726–728; 385/39, 47
See application file for complete search history.

(56) References Cited

U.S. PATENT DOCUMENTS

| | | | | |
|---|---|---|---|---|
| 3,923,394 | A | 12/1975 | Frankiewicz | |
| 5,828,803 | A * | 10/1998 | Eckhouse | 385/88 |
| 6,385,371 | B1 * | 5/2002 | Li | 385/43 |
| 6,527,411 | B1 * | 3/2003 | Sayers | 362/245 |
| 6,843,591 | B1 * | 1/2005 | Peng et al. | 362/560 |
| 2005/0231974 | A1 * | 10/2005 | Ruffin | 362/555 |
| 2005/0243570 | A1 * | 11/2005 | Chaves et al. | 362/551 |

* cited by examiner

*Primary Examiner*—Julie A Shallenberger
(74) *Attorney, Agent, or Firm*—D. Austin Bonderer

(57) ABSTRACT

A mixed light apparatus for mixing light emitted from a first light source and a second light source includes a body, a first light reflecting element and a second light reflecting element. The body has a light emitting surface. A first reflecting element extends from the light emitting surface. The first light reflecting element has a first emanating point and a first focal point. The first light source is disposed at the first focal point. A second reflecting element extends from the light emitting surface. The second light reflecting element has a second emanating point and a second focal point. The second light source is disposed at the second focal point. The first emanating point and the second emanating point overlaps and are disposed on the light emitting surface.

3 Claims, 4 Drawing Sheets

MIXED LIGHT APPARATUS

BACKGROUND

1. Technical Field

Embodiments of the present disclosure relate to mixed light apparatuses, and more particularly to a mixed light apparatus for a liquid crystal display.

2. Description of Related Art

Liquid crystal displays (LCDs) are extensively used in a variety of electronic devices. However, LCDs are not self-luminescent, therefore, backlight modules are required to illuminate the LCDs. Generally, the backlight modules can be categorized as direct structures and edge structures. Because the direct type backlight module can provide better illumination in comparison with the edge backlight module, direct type backlight modules are more widely employed.

One such direct type backlight module 10 is disclosed in FIG. 1. The direct type backlight module 10 includes a substrate 11, a light source 12 and a diffusion plate 14. The light source 12 is disposed on the substrate 11. The light source 12 may employ a plurality of point light sources (e.g., light emitting diode (LED)) or a linear light source (e.g., cold cathode fluorescent lamp (CCFL)). An LED array is extensively employed as the light source 12 for LCD because the LED has merits of deprivation of mercury pollution, high color saturation and long lasting. The diffusion plate 14 is disposed above the substrate 11 for allowing the light emitted from the light source 12 to be uniform and providing light for an associated display panel.

The LED array consists of a plurality of red LEDs 12*a*, green LEDs 12*b* and blue LEDs 12*c*. The LEDs 12*a*, 12*b*, 12*c* are uniformly spread evenly on the substrate 11 according to the color of emitted light. Particularly, rows of red LEDs 12*a*, green LEDs 12*b*, and blue LEDs 12*c* are arranged in alternating fashion. Red, green, and blue light, is emitted from the light source 12 and mixed continuously until reaching the diffusion plate 14 to produce white light. A predetermined distance between the light source 12 and the diffusion plate 14 is required for mixing the emitted light and providing uniform illumination.

Recently, because of an increase in demand for thin and lightweight LCDs, the distance provided for mixing emitted light has shortened, resulting in poor mixing and producing yellowish bluish light rather than the intended white light.

In addition, when a large number of red, green and blue LEDs are utilized for large-scale LCD production, the white light emitted from such an LCD has low energy and low color saturation. Moreover, the color of mixed light in such manner cannot be adjusted as desired.

What is needed, therefore, is a mixed light apparatus for providing adjustable color light and having improved color saturation, improved uniformity, and high energy.

SUMMARY

A mixed light apparatus is provided. In one embodiment, the mixed light apparatus for mixing light emitted from a first light source and a second light source includes a body, a first light reflecting element, and a second light reflection. The body has a light emitting surface. A first reflecting element extends from the light emitting surface. The first light reflecting element has a first emanating point and a first focal point. The first light source is disposed at the first focal point. A second reflecting element is extends from the light emitting surface. The second light reflecting element has a second emanating point and a second focal point. The second light source is disposed at the second focal point. The first emanating point and the second emanating point overlap one another and are disposed on the light emitting surface.

Advantages and novel features of the present mixed light apparatus will become more apparent from the following detailed description of preferred embodiments when taken in conjunction with the accompanying drawings.

BRIEF DESCRIPTION OF THE DRAWINGS

The components in the drawing are not necessarily drawn to scale, the emphasis instead being placed upon clearly illustrating the principles of the present invention.

Figure 1:
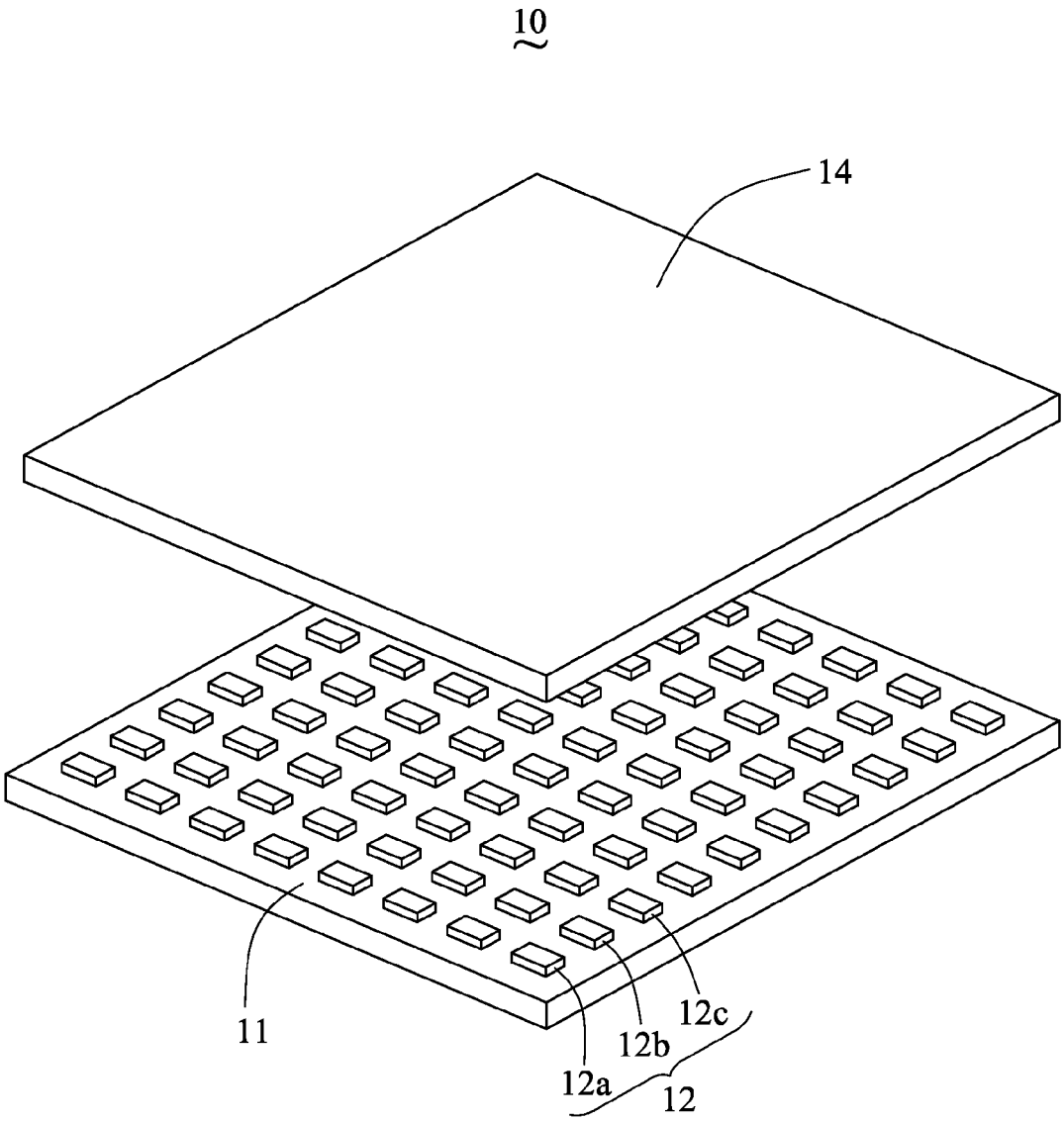
FIG. 1 (PRIOR ART)
FIG. 1 is a schematic view of one embodiment of a direct type backlight module.

Corresponding reference characters indicate corresponding parts. The exemplifications set out herein illustrate at least one preferred embodiment of the present mixed light apparatus, in one form, and such exemplifications are not to be construed as limiting the scope of the present disclosure in any manner.

DETAILED DESCRIPTION OF CERTAIN INVENTIVE EMBODIMENTS

Reference will now be made to the drawings to describe embodiments of the present mixed light apparatus in detail.

Figure 2:
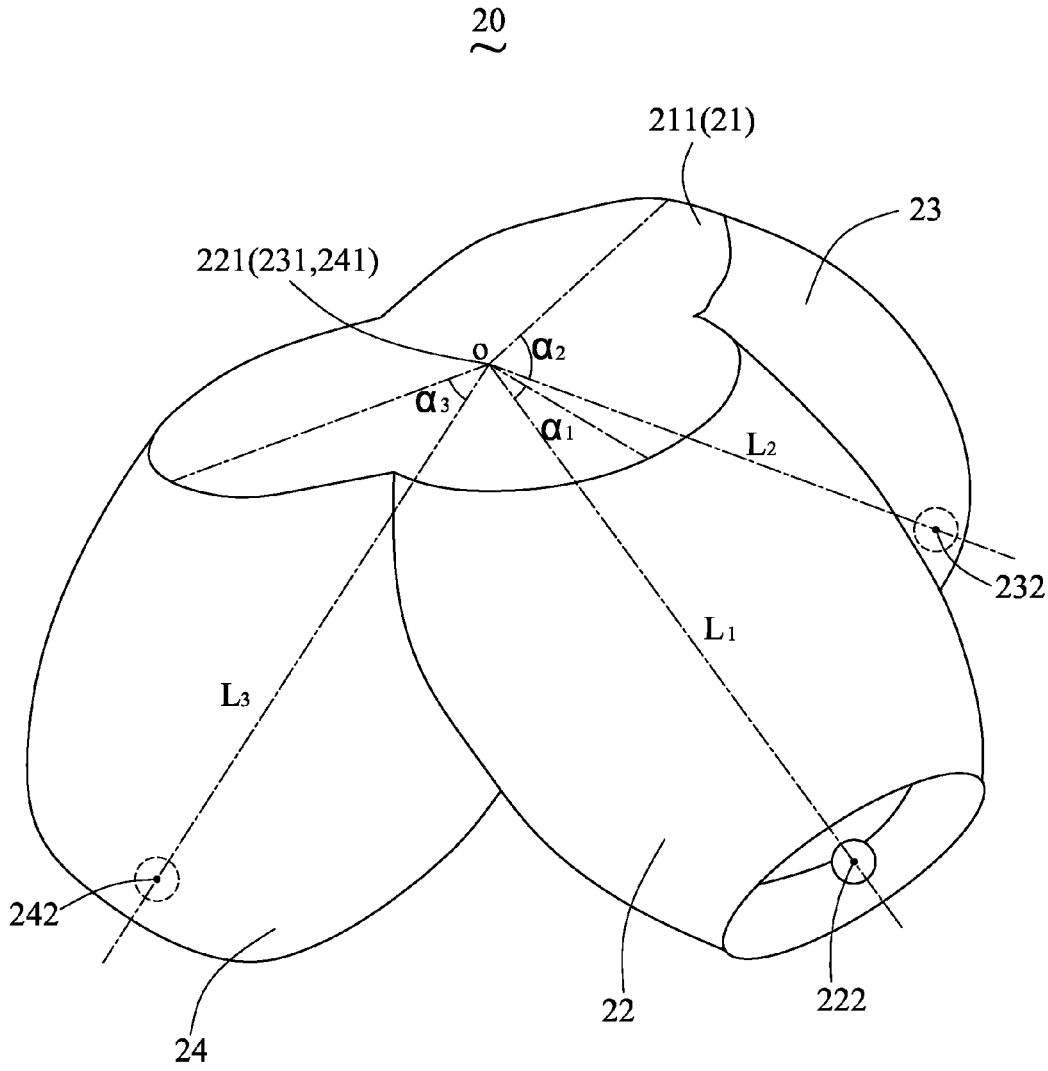
FIG. 2 is a schematic view of one embodiment of a mixed light apparatus in accordance with the present disclosure.
Figure 3:
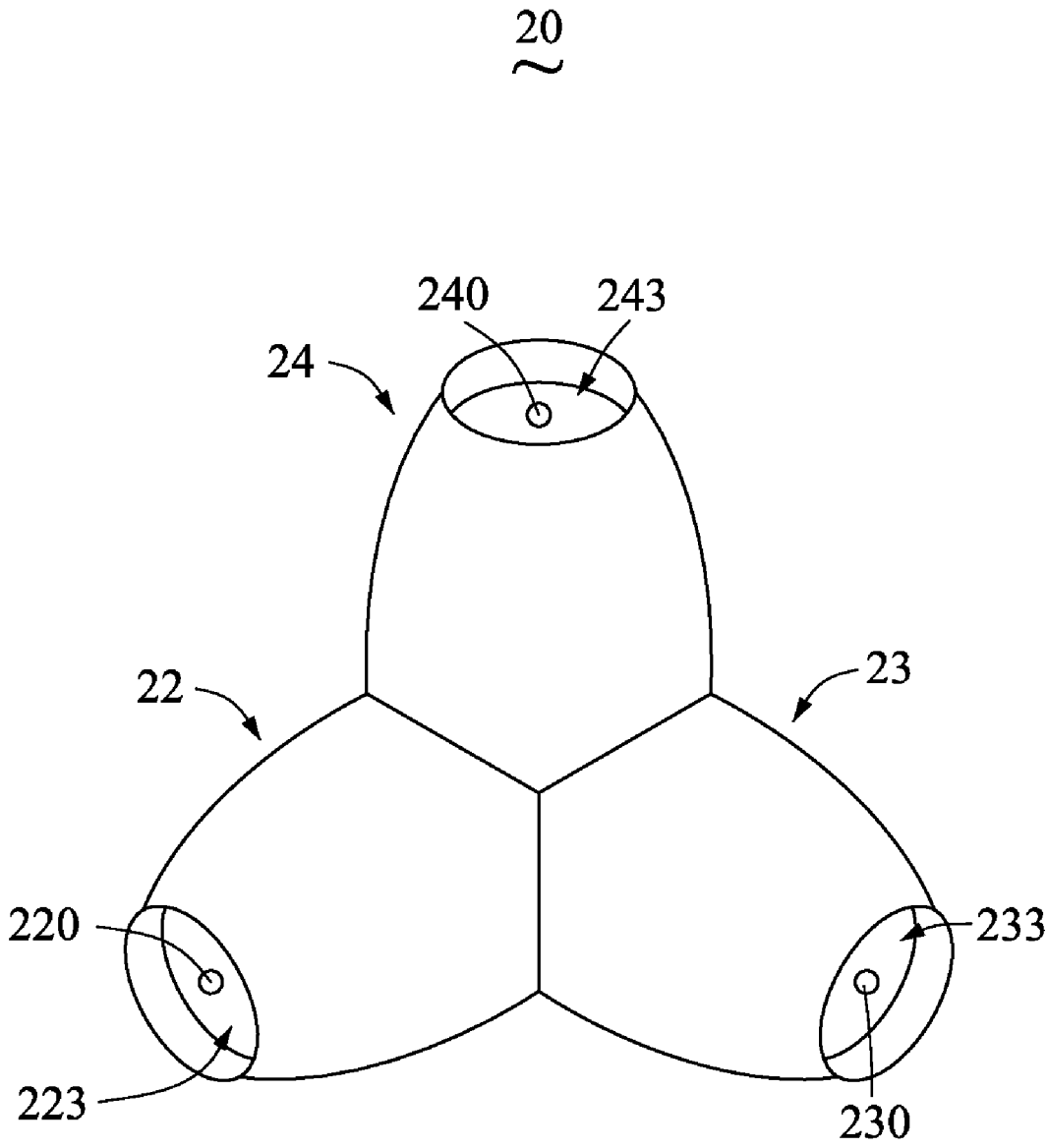
FIG. 3 is a schematic view from below of one embodiment of the mixed light apparatus of FIG. 2.

With reference to FIG. 2 and FIG. 3, one embodiment of a mixed light apparatus in accordance with the present disclosure is shown. The mixed light apparatus 20 may be used for mixing light emitted from at least two light sources to be displayed on an LCD (not shown). In one embodiment, the mixed light apparatus 20 includes a body and at least two light reflecting elements. Each of the at least two light sources is disposed corresponding to one of the light reflecting elements.

In one embodiment, the mixed light apparatus 20 includes a first light reflecting element 22, a second light reflecting element 23, and a third light reflecting element 24. In addition, a first light source 220, a second light source 230, and a third light source 240 are disposed in correspondence with each of the light reflecting elements 22, 23, 24. In the present embodiment, each of the light reflecting elements 22, 23, 24 has a solid oval-shaped body, and is made of a substantially transparent material, such as glass or polymethyl methacrylate (PMMA).

The body 21 has a light emitting surface 211. The first light reflecting element 22 is disposed extending from the light emitting surface 211. The first light reflecting element 22 has a first emanating point 221 and a first focal point 222. The first light source 220 is disposed at the first focal point 222. In addition, the first emanating point 221 and the first focal point 222 are on a first axis $L_1$.

The second light reflecting element 23 is positioned adjacent to the first light reflecting element 22 and extends from the light emitting surface 211. The second light reflecting element 23 has a second emanating point 231 and a second focal point 232. The second light source 230 is disposed at the second focal point 232. In addition, the second emanating point 231 and the second focal point 232 are on a second axis $L_2$.

The third light reflecting element 24 is positioned adjacent to the first light reflecting element 22 and extends from the light emitting surface 211. The third light reflecting element 24 has a third emanating point 241 and a third focal point 242. The third light source 240 is disposed at the third focal point 242. In addition, the third emanating point 241 and the third focal point 242 are on a third axis $L_3$.

The first emanating point 221, the second emanating point 231, and the third emanating point 241 overlap one another and are disposed on the light emitting surface 211. That is, the first axis $L_1$, the second axis $L_2$ and the third axis $L_3$ meet at a common point O. The common point O is defined on the light emitting surface 211. $\alpha_1$ is an inclined angle of the first axes $L_1$ and the light emitting surface 211. $\alpha_2$ is an inclined angle of the second axes $L_2$ and the light emitting surface 211. $\alpha_3$ is an inclined angle of the third axes $L_3$ and the light emitting surface 211. The inclined angles $\alpha_1$, $\alpha_2$, $\alpha_3$ range from about 40 degrees to about 70 degrees depending on the embodiment. In one embodiment, the inclined angles $\alpha_1$, $\alpha_2$ and $\alpha_3$ may be about 60 degrees. However, depending on the embodiment, angles between the first axis $L_1$, the second axis $L_2$ and the third axis $L_3$ may be approximately of equal degrees or have varying degrees.

The light emitting surface 211 is disposed opposite to the light sources 220, 230, 240. The light emitting surface 211 can be a plane surface. It is understood that the shape of the light emitting surface 211 is not limited to what is mentioned above. Alternatively, the light emitting surface 211 can be a curved surface. Each of the light sources 220, 230, 240 can be a light-emitting diode (LED), such as a single-color LED or a multi-color LED. In the present embodiment, the first light source 220 is a red LED. The second light source 230 is a green LED. The third light source 240 is a blue LED.

Figure 4:
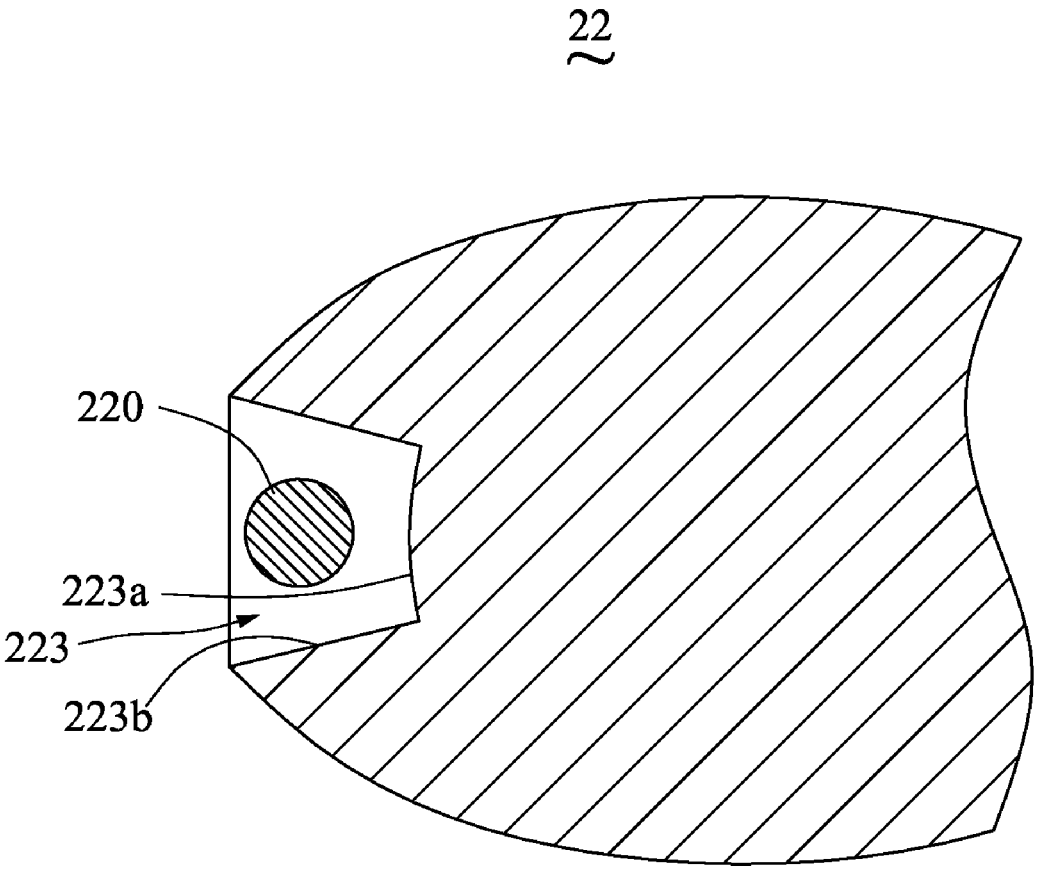
FIG. 4 is a schematic sectional view of one embodiment of a light reflecting element of the mixed light apparatus of FIG. 2.

Referring to FIG. 3 and FIG. 4, each of the light reflecting elements 22, 23, 24 respectively comprises a concave structure 223, 233, 243 disposed at one end thereof. Additionally, each of the light reflecting elements 22, 23, 24 is correspondingly located near the light sources 220, 230, 240. The concave structures 223, 233, 243 are configured to accommodate the light sources 220, 230, 240 disposed at the focal points 222, 232, 242. Referring to FIG. 4, a schematic sectional view of one embodiment of the first light reflecting element 22 is shown. The concave structure 223 is in a shape of a truncated cone but may, for example, be cylinder shaped. In addition, the concave structure 223 has a circular bottom 223*a*. Depending on the embodiment, a curvature radius of the circular bottom 223*a* may approximately range from 2.6 mm to 3.5 mm.

In order to simply explain the mixed light apparatus 20 according to the present embodiment, the first light reflecting element 22, is described in greater detail. However, it may be understood that the second light reflecting element 23 and the third light reflecting element may be explained in a substantially similar manner.

The first light source 220, disposed at the first focal point 222, emits light into the solid light reflecting element 22 via a lateral surface 223*b* and/or the circular bottom 223*a* of the concave structure 223. An incident light is reflected in the first light reflecting element 22 and converges at the first emanating point 221 on the light emitting surface 211, and then diverges from the first emanating point 221.

In order to enhance the reflection efficiency, a reflection enhancement film is disposed on an outside surface of the light reflecting element 22. In addition, a light scattering film may be disposed on the light emitting surface 211 to effectively scatter light emitted therefrom.

The second light reflecting element 23 and the third light reflecting element 24 are similar as the first reflecting element 22. Because the emanating points 221, 231, 241 overlap one another, light separately emitted from the first light source 220, the second light source 230, and the third light source 240 converges at the common point O (i.e., the emanating points 221, 231, 241, where the light is mixed to produce white light). Therefore, the emitted white light produced by the mixed light apparatus 20 of the present embodiment has a high color saturation, uniformity, and a high energy. Furthermore, the light sources 220, 230, 240 can be connected to a controller so as to allow adjustment of the color of the light emitted from the light sources 220, 230, 240. That is, the mixed light apparatus is not limited to producing only white light.

Finally, it is to be understood that the above-described embodiments are intended to illustrate rather than limit the present disclosure. Variations may be made to the embodiments without departing from the spirit of the present disclosure as claimed. The above-described embodiments illustrate the scope of the present disclosure but do not restrict the scope of the present disclosure.

What is claimed is:

1. A mixed light apparatus comprising:

a first light reflecting element having a first emanating point and a first focal point;

a first light source disposed at the first focal point;

a second light reflecting element having a second emanating point and a second focal point;

a second light source disposed at the second focal point;

a third light reflecting element having a third emanating point and a third focal point; and a third light source disposed at the third focal point;

wherein the first light reflecting element, the second light reflecting element, and the third light reflecting element intersect with each other and form a light emitting surface at intersections between them; and wherein the first emanating point, the second emanating point, and the third emanating point overlap one another and are disposed on the light emitting surface;

wherein the first emanating point and the first focal point are on a first axis, the second emanating point and the second focal point are on a second axis, and the third emanating point and the third focal point are on a third axis; the first axis and the light emitting surface define a first inclined angle ranging from about 40 degrees to about 70 degrees; the second axis and the light emitting surface define a second inclined angle ranging from about 40 degrees to about 70 degrees; the third axis and the light emitting surface define a third inclined angle ranging from about 40 degrees to about 70 degrees.

2. The mixed light apparatus as claimed in claim 1, wherein each of the first light reflecting element, the second light reflecting element, and the third light reflecting element is a solid body having an oval-shape.

3. The mixed light apparatus as claimed in claim 1, wherein the first light source, the second light source, and the third light source are a red light emitting diode, a green light emitting diode, and a blue light emitting diode, respectively.

* * * * *